United States Patent [19]

England

[11] 4,044,562

[45] Aug. 30, 1977

[54] MULTIROTARY ENERGY CONVERSION VALVE

[76] Inventor: Will Clarke England, 7310 Eastcrest Drive, Austin, Tex. 78752

[21] Appl. No.: 466,874

[22] Filed: May 2, 1974

[51] Int. Cl.[2] ..... F01K 27/00

[52] U.S. Cl. ..... 60/721; 290/1 R

[58] Field of Search ..... 418/9; 60/650, 682, 60/721; 417/252, 251, 440; 290/1 R, 2

[56] References Cited

U.S. PATENT DOCUMENTS

| | | | |
|---|---|---|---|
| 1,753,280 | 4/1930 | Baumann et al. | 417/251 X |
| 2,009,137 | 7/1935 | Kleckner | 417/252 |
| 3,238,738 | 3/1966 | Webber | 417/251 X |
| 3,481,532 | 12/1969 | Fraser | 418/9 |
| 3,667,874 | 6/1972 | Weatherston et al. | 418/9 |
| 3,750,393 | 8/1973 | Minto | 60/671 X |

*Primary Examiner*—Allen M. Ostrager

[57] ABSTRACT

A multirotary energy conversion valve comprising inlet and outlet passages interposed by meshing pairs of inlet and outlet rotors of unequal constant volume displacements with an enclosed channel in between having energy conversion means and additionally interposed by meshing intermediate rotors of unequal constant volume displacements with at least one rotary linkage connecting an inlet and an outlet rotor and additionally an intermediate rotor in synchronous rotation about one axis, said valve being applicable in a range including check valves, heat pumps, heat engines, vacuum pumps, vapor flash valves, cool engines, direct air conditioners and nuclear fusion devices.

8 Claims, 24 Drawing Figures

1
2
3
4
5
6a
7
8
9

1
2
3
4
5
6a
7
8
9

MULTIROTARY ENERGY CONVERSION VALVE

SUBJECT MATTER OF THE INVENTION

The invention relates to energy conversion valves and relates more specifically to multirotary valves of inlet and outlet stages of constant volume displacements with energy conversion means for the continuously enclosed channel.

OBJECTS OF THE INVENTION

Valves are utilized for controlling, checking or regulating fluid flow, fluid pressure, fluid velocity and volumetric expansion, usually by varying frictional flow characteristics. Compressors with power input are utilized to increase the pressure of a compressible fluid and its volumetric flow. Pumps with power input are utilized to increase the pressure of an incompressible fluid and its volumetric flow. Expanders are utilized to convert fluid pressure to fluid flow with power output. Heat engines expend heat energy to perform useful work. Heat pumps expend useful work to transfer heat from one substance to another.

It is an object of this Invention to provide a multirotary valve of integral interacting elements of such versatility as to be utilizable in any of the aforementioned functions as well as some which are unknown to the art.

Another object of this Invention is to provide a means of input and output of mechanical torque in a variety of rotary drives set at an almost unlimited range of angles.

A further object of this Invention is to provide a basic multirotary valve of such simplicity and multiplicity that the efficiency of the energy conversions available will approach ideal conditions.

Still another object of this invention is to provide a fundamental multirotary valve adaptable to a multitude of applications with various appurtenant devices without any substantial alteration in the fundamental multirotary valve.

A still further object of this Invention is to provide a multiple arrangement of the elements of the multirotary valve capable of producing nuclear fusion in a flowing plasma.

Other objects and advantages of this Invention will become apparent through consideration of the following description and appended claims in conjunction with the attached drawings in which:

DETAILED DESCRIPTION OF PREFERRED EMBODIMENT OF INVENTION

Figures 1, 2, 3:
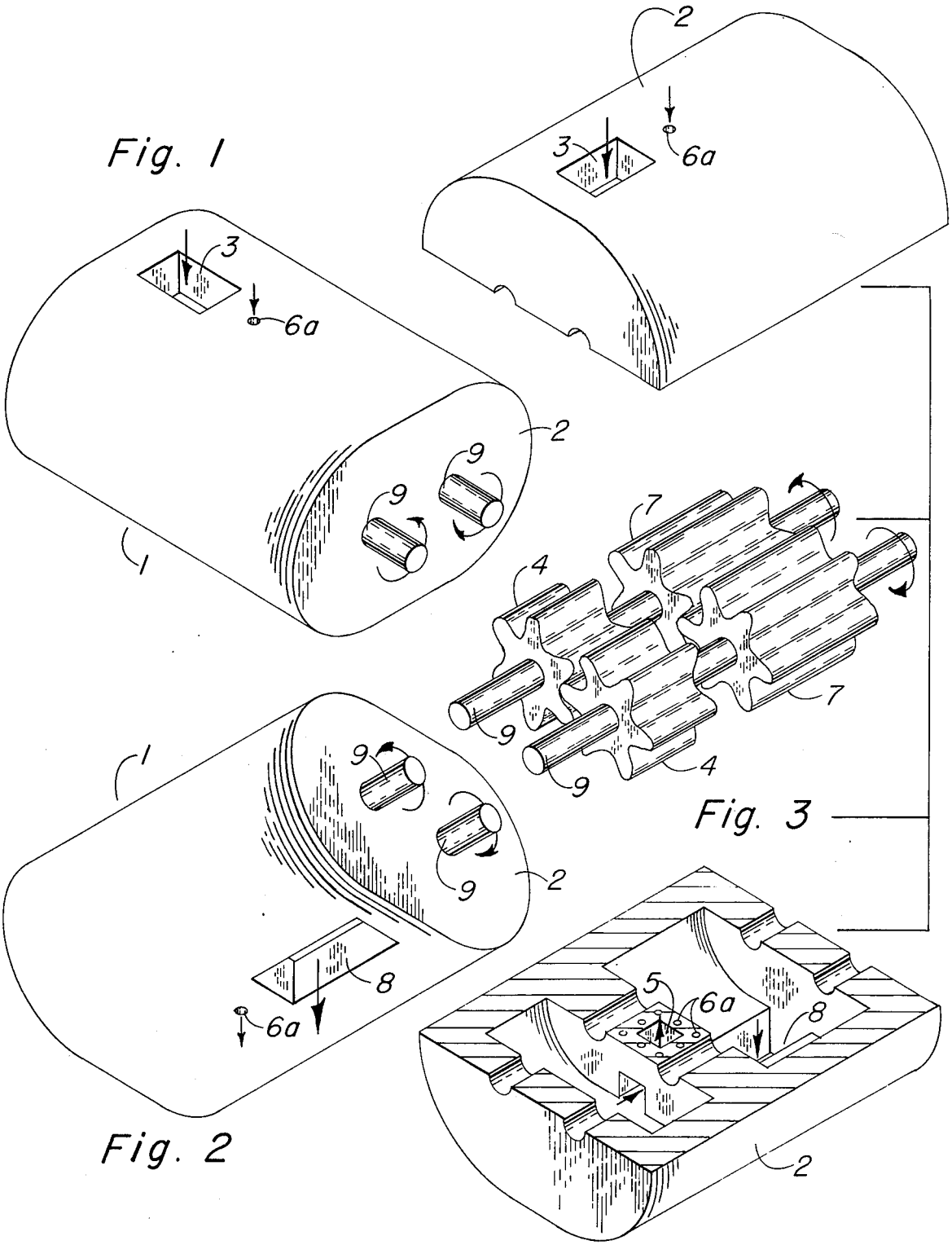
FIG. 1 is an inlet pictorial view of a parallel axes version of the multirotary valve with inlet rotors having smaller torque and volumetric displacement than the outlet rotors.
FIG. 2 is an outlet pictorial view of a parallel axes version of the multirotary valve with inlet rotors having smaller torque and volumetric displacement than the outlet rotors.
FIG. 3 is an exploded pictorial view of a parallel axes version of the multirotary valve with inlet rotors having smaller torque and volumetric displacement than the outlet rotors.
Figure 4:
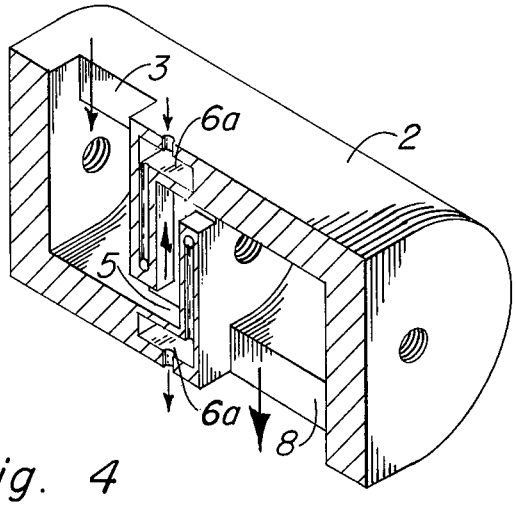
FIG. 4 is a sectional pictorial view of a parallel axes version of the multirotary valve casing with inlet rotors having smaller torque and volumetric displacement than the outlet rotors.
Figure 5:
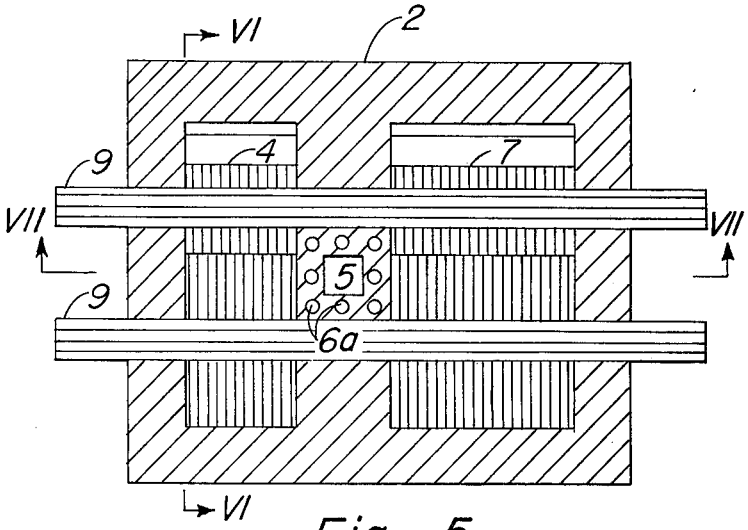
FIG. 5 is a section taken on line V—V of FIGS. 6 and 7.
Figure 6:
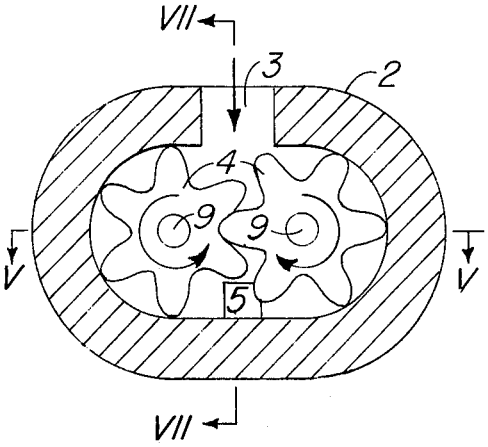
FIG. 6 is a section taken on line VI—VI of FIGS. 5 and 7.
Figure 7:
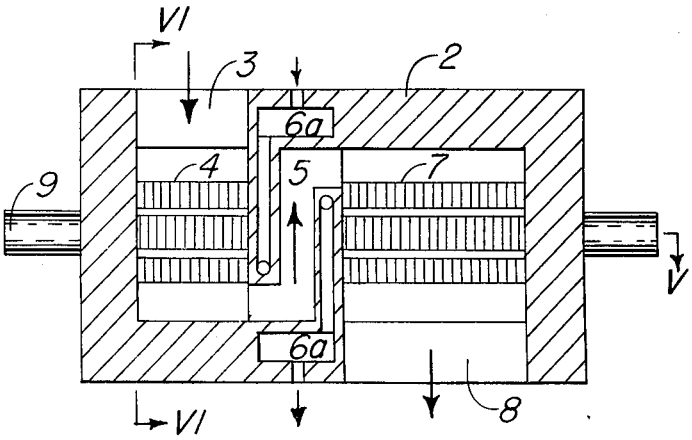
FIG. 7 is a section taken on line VII—VII of FIG. 5 and 6.

With reference to the patent drawings, my invention of a multirotary energy conversion valve 1 comprises, in general: a valve casing 2; an inlet passage 3 in said valve casing 2, leading to a pair of meshing inlet rotors 4 of constant volume displacements rotatably mounted in said valve casing 2; an enclosed channel 5 having energy conversion means 6, in said valve casing 2 leading from said inlet rotors 4 to a pair of meshing outlet rotors 7 of constant volume displacements rotatably mounted in said valve casing 2; an outlet passage 8 in said valve casing 2 leading from said outlet rotors 7; and a rotary linkage 9 drivingly connecting an inlet rotor 4 and an outlet rotor 7 in synchronous rotation about one axis and being accessible for rotary drive purposes.

The design of the valve casing 2 is mainly a function of the configuration of the rotary elements, however, synthesis of the composite parts of the valve casing 2 is a function of the manufacturing art and machining capabilities. The drawings illustrate the design of the valve casing 2.

The inlet passage 3, illustrated by a uniform rectangular cross-section and straight path need not be limited to such a shape since its main function is to convey the fluid from its source to the reappearing volumetric displacement side of the meshing inlet rotors 4 of constant volume displacements.

The pair of meshing inlet rotors 4 fitting snugly in the valve casing 2 convey the fluid from the inlet passage 3 to the enclosed channel 5 via the rotation of the meshing irregular shaped peripheries of the rotors forming moving spaces of constant volumes with the valve casing 2. The latter being the only desired means of conveyance, it is necessary that the meshing inlet rotors 4 be of such a continous mesh and fit in said valve casing 2 as to deter any other fluid transit between the inlet passage 3 and the enclosed channel 5. The rotation of the inlet rotors 4 through the mesh describes a vanishing volumetric displacement side, being before the entrance of the irregular shaped peripheries of the inlet rotors 4, into a continuous mesh that precludes volumetric displacement through the mesh to the reappearing volumetric displacement side of the inlet rotors 4.

The enclosed channel 5, basically illustrated by a uniform rectangular cross-section, need not be limited to such a shape nor its illustrated zig-zag path since its main function is to contain the fluid during its energy conversion and allow conveyance of the fluid to the reappearing volumetric side of the meshing outlet rotors 7.

Figures 8, 9, 10:
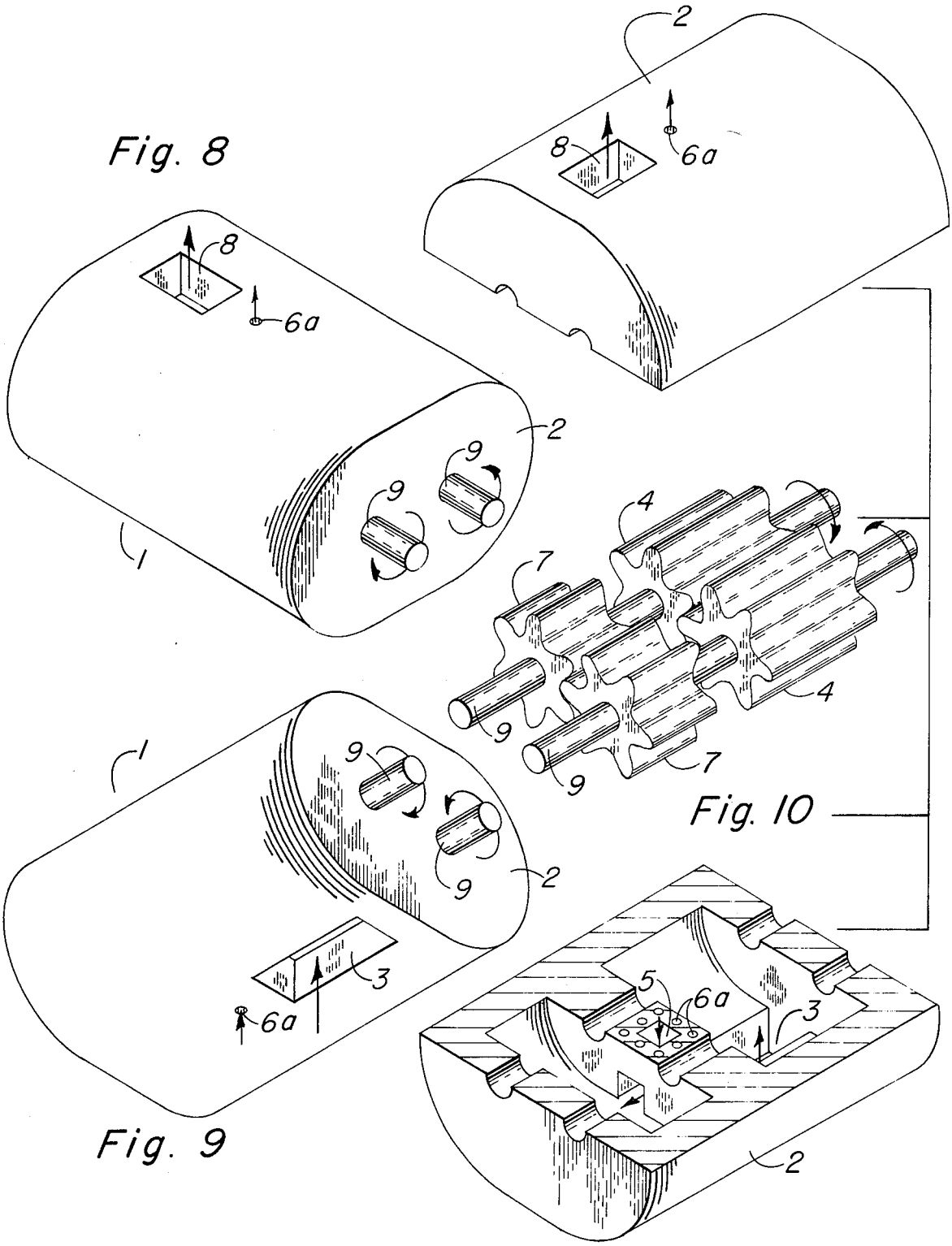
FIG. 8 is an outlet pictorial view of a parallel axes version of the multirotary valve with inlet rotors having greater torque and volumetric displacement than the outlet rotors.
FIG. 9 is an inlet pictorial view of a parallel axes version of the multirotary valve with inlet rotors having greater torque and volumetric displacement than the outlet rotors.
FIG. 10 is an exploded pictorial view of a parallel axes version of the multirotary valve with inlet rotors having greater torque and volumetric displacement than the outlet rotors.

The energy coversion means 6 is illustrated to be a heat exchange means **6*a* in FIGS. 1 through 10, however, it is to be noted that the simplest energy conversions of a high pressure fluid to a low pressure fluid with torque output and of a low pressure fluid to a high pressure fluid with torque input, can be accomplished by the basic multirotary valve 1 consisting of valve casing 2, inlet passage 3 and rotors 4, enclosed channel 5, outlet rotors 7 and passage 8 and rotary linkage 9. Also, conversion of a high pressure fluid to a higher pressure fluid in the enclosed channel 5 causes the multirotary valve 1 to act as a check valve stopping all fluid flow such as illustrated by FIGS. 8 through 10 without the heat exchange means 6*a*** in operation.

The pair of meshing outlet rotors 7 of constant volume displacements are of the same fundamental characteristics as said meshing inlet rotors 4, but are quantitatively unequal in volumetric displacement per revolution and torque characteristics to the same characteristics of said meshing inlet rotors 4. Volumetric displacement per revolution is defined as the product of: a shape coefficient; half the mean pitch of the repeating meshing peripheral irregularities; the radial depth of the meshing peripheral irregularities; the width of the rotor meshing peripheral irregularities and the number of repeated meshing irregularities. Torque is a function of the pressure on the rotors and the radial area moment where the radial area moment of a rotor is defined as the product of the width of the rotor meshing peripheral irregularities, the radial depth of the meshing peripheral irregularities and the radius from the axis of rotation to the mean circumference of the meshing peripheral irregularities. The mean circumference of the meshing peripheral irregularities is the sum of the mean pitches and is defined as the centerline of the volumetric displacement of each rotor.

The outlet passage 8, illustrated by a uniform rectangular cross-section and straight path, need not be limited to such a shape since its main function is to convey the fluid from the vanishing volumetric displacement side of said meshing outlet rotors 7 to whatever the multirotary valve 1 is connected.

The pair of meshing intermediate rotors 10 of constant volume displacements are of the same fundamental characteristics as said meshing inlet rotors 4 and outlet rotors 7, but are quantitively unequal in volumetric displacement per revolution and torque characteristics to the same characteristics of said inlet and outlet rotors. FIGS. 14 through 17 illustrate a multirotary valve 1 with one pair of meshing intermediate rotors 10 of constant volume displacements. A multiplicity of pairs of inlet, intermediate and outlet rotors could be utilized in a multirotary valve 1 for increasing or decreasing the pressure of a thermodynamically reactive fluid in discrete steps for high pressure or vacuum operations.

Figure 18:
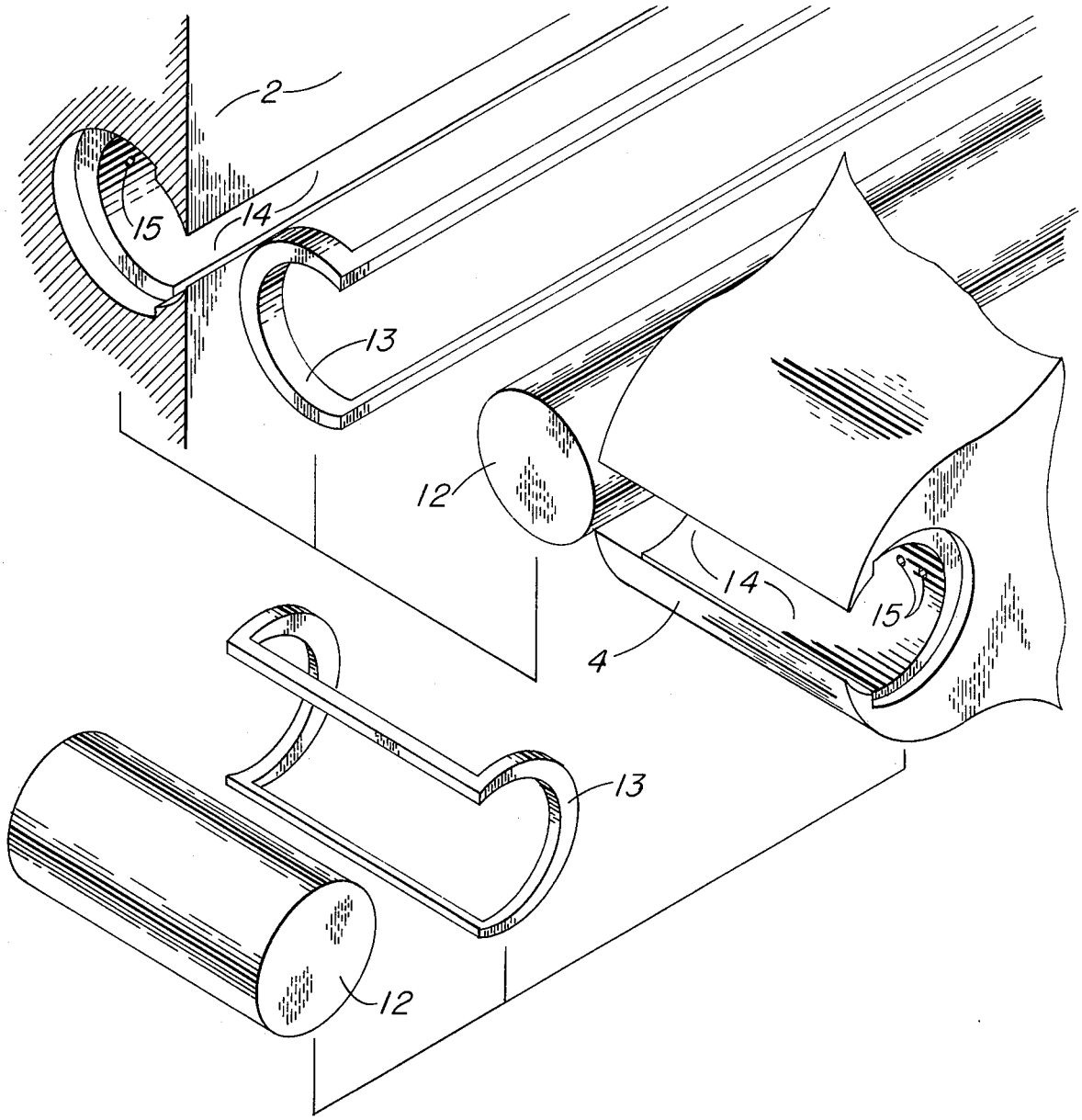
FIG. 18 is an exploded pictorial view illustrating the sealing and lubricating rollers.

Although sealing and lubricating means are available within the state of the art, this multirotary energy conversion valve is especially adaptable to pure rotary parts which could also include lubricating rolling seals having a bearing capability. FIG. 18 is an illustration of such rollers 12 installed in roller seals 13 which can be inserted in roller niches 14 located in strategic places in the meshing irregular peripheries of the inlet rotors 4 and outlet rotors 7 and in the valve casing 2, rollable on the sides of said rotors along the planes of mesh and between other pressure differentials such as between the inlet passage 3 and the enclosed channel 5 and between the enclosed channel 5 and the outlet passage 8. The rollers 12 in the rotors will roll upon the inner perimeter of the valve casing 2 and upon the meshing irregular peripheries of the rotors themselves in the meshing contact area. The rollers 12 in the valve casing 2 will roll upon the sides of the rotors, but some differential sliding can occur dependent upon the differential speeds along the sides of the rotors or the meshing irregular peripheries. As the rollers 12 are slidably secured in the roller niches 14 by the roller seals 13, lubricating ducts 15 can introduce lubrication to the rollers without any losses other than that required by said rollers 12. This could even be insured by multiple roller seals 13, one set within another.

Figure 19:
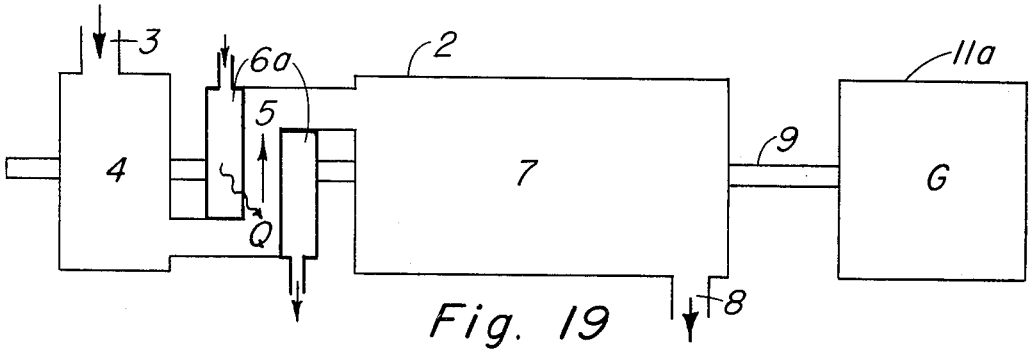
FIG. 19 is a schematic illustrating a heat engine multirotary valve with power output.

FIG. 19 illustrates a "heat" engine multirotary valve 1 having greater constant volume displacements per revolution for the outlet rotors 7 than the inlet rotors 4. Heat (symbolized by Q and a wavy arrow) from the heat exchange **6*a* expands the thermodynamically reactive fluid under enclosed channel 5 pressure and causes the rotors to turn in the direction for exhausting the heated fluid by the outlet rotors 7 and for intake of cooler fluid by the inlet rotors 4, thus producing power output for a power utilizing means 11*a***.

Figure 20:
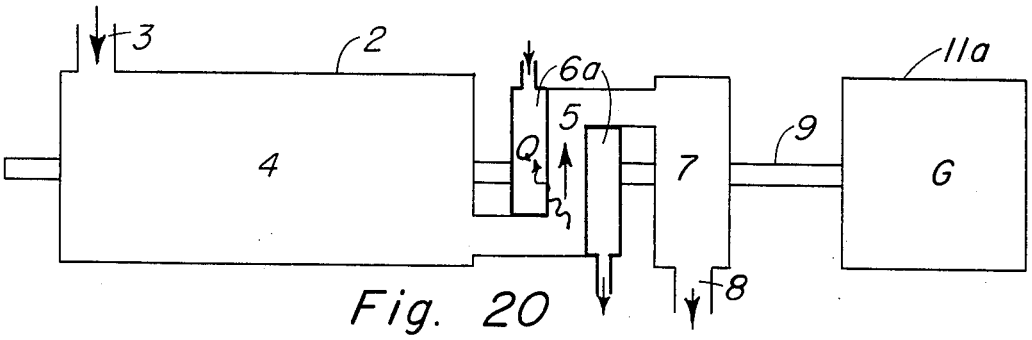
FIG. 20 is a schematic illustrating a cool engine multirotary valve with power output.

FIG. 20 illustrates a "cool" engine multirotary valve 1 having greater constant volume displacements per revolution for the inlet rotors 4 than the outlet rotors 7. Heat taken from the thermodynamically reactive fluid in the enclosed channel 5 by the heat exchange means **6*a* contracts the fluid and reduces the pressure below the external fluid pressure which rotates the inlet rotors 4 by greater applied torque, thus exhausting the cooler fluid by the outlet rotors 7 and intaking the hotter external fluid by the inlet rotors 4, and producing power output for a power utilizing means 11***a*.

Figure 21:
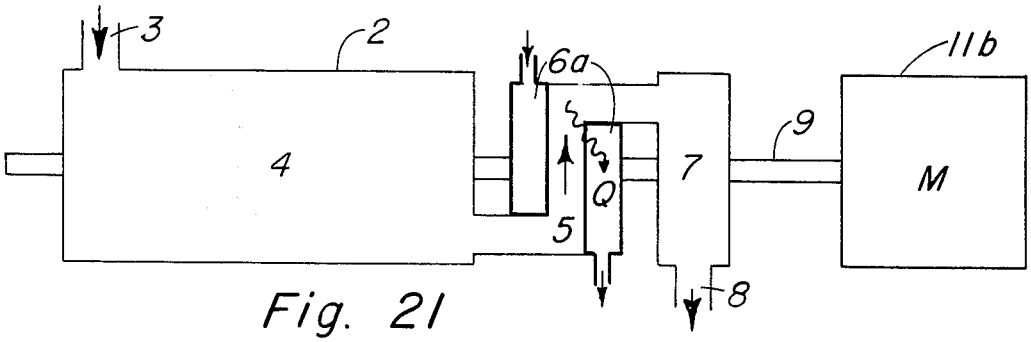
FIG. 21 is a schematic illustrating a heat pump multirotary valve with power input.

FIG. 21 illustrates a "heat" pump multirotary valve 1 having greater constant volume displacements per revolution for the inlet rotors 4 than the outlet rotors 7, with power driving means 11*b* providing power input. A thermodynamically reactive fluid introduced by the inlet rotors 4 is compressed in the enclosed channel 5 and accordingly the temperature of said fluid increases. The heat exchange means 6*a* absorbs and removes the heat from said hotter fluid and said fluid is exhausted by the outlet rotors 7. If the outlet pressure is the same as the inlet pressure the exhausted and expanded thermodynamically reactive fluid will be cooler than it was before intake.

Figure 22:
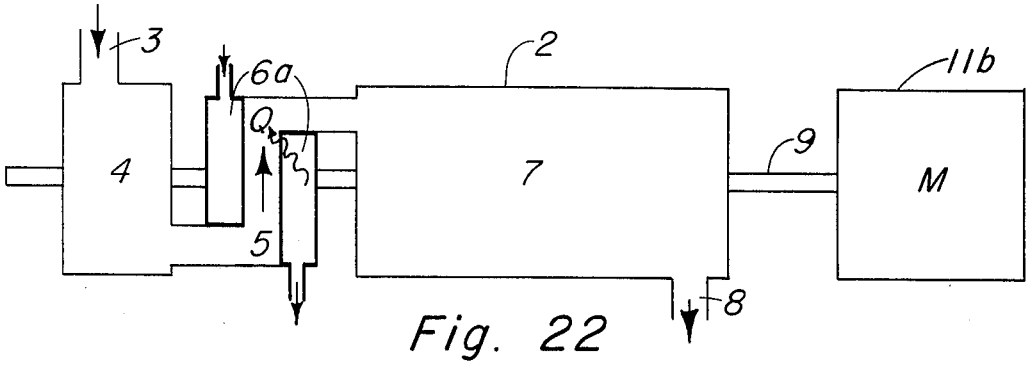
FIG. 22 is a schematic illustrating a cool pump multirotary valve with power input.

FIG. 22 illustrates a "cool" pump multirotary valve 1 having greater constant volume displacements per revolution for the outlet rotors 7 than the inlet rotors 4, with power driving means 11*b* providing power input. A thermodynamically reactive fluid introduced by the inlet rotors 4 is expanded in the enclosed channel 5 and accordingly the temperature of said fluid decreases. The heat exchange means 6*a* transfers and adds heat to said cooler fluid and said fluid is exhausted by the outlet rotors 7. If the outlet pressure is the same as the inlet pressure the exhausted and compressed thermodynamically reactive fluid will be hotter than it was before intake.

The "heat" pump multirotary valve 1 is called such in relation to air in that it would remove heat from the air thus increasing the temperature of the heat exchange medium. The "cool" pump multirotary valve 1 is called such in relation to air in that it would add heat to the air from a heat exchange medium at the initial temperature of the air.

It must be noted that the above four functions can all be performed by the multirotary valve 1 illustrated in FIGS. 1 through 7 by: (1) providing power utilizing means 11*a* (2) switching inlet for outlet, and (3) substituting power driving means 11*b* for power utilizing means 11*a;* the heat engine having a hot heat exchange medium, the "cool" engine having a cold heat exchange medium, and the "heat" and "cool" pumps having equal temperatures for the initial thermodynamically reactive fluid and the heat exchange medium. None of these require alteration of the multirotary valve 1.

While the heat exchange means 6*a* is herein well illustrated as an energy conversion means 6 as is the one way altered fluid flow and the mechanical energy input and output, the multirotary energy conversion valve 1 also can have energy conversion means 6 such as thermoelectrical means and magnetohydrodynamic means. All of the latter are simple energy conversions but all must also derive their energy sources externally from heat differentials, pressure heads, electrical or mechanical input.

Figure 23:
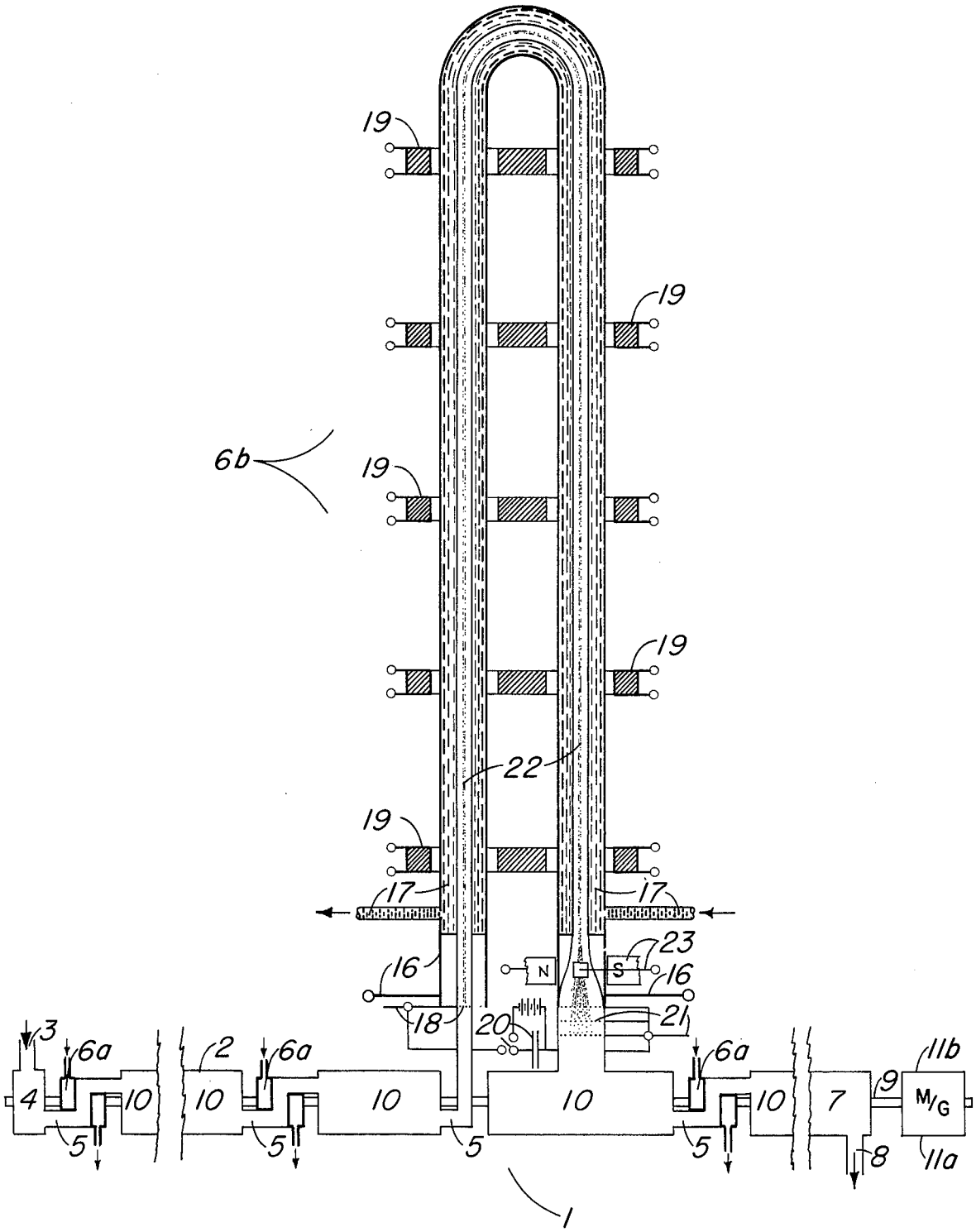
FIG. 23 is a schematic illustrating a fusion multirotary energy conversion valve.
Figure 24:
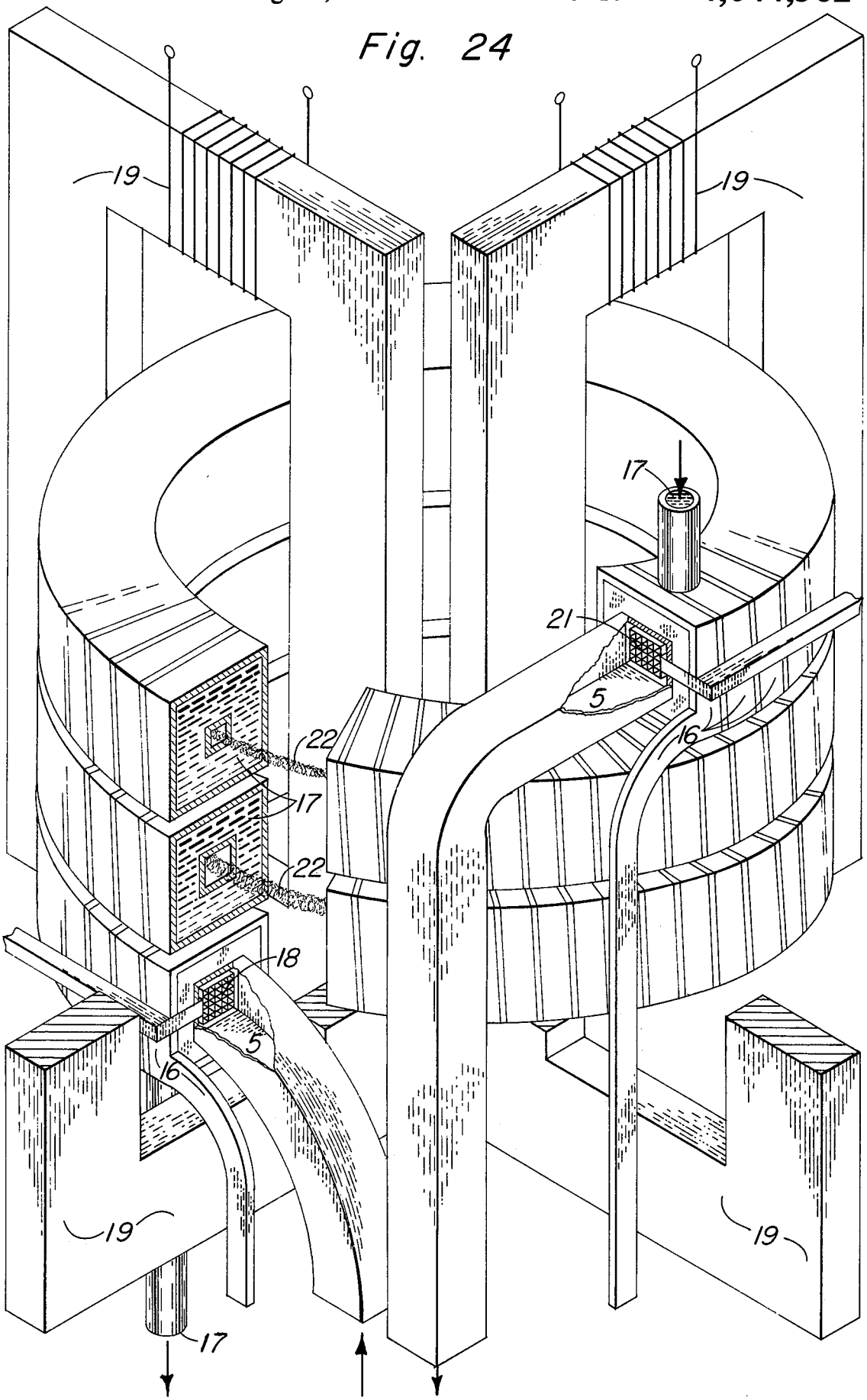
FIG. 24 is a sectioned pictorial of the flowing plasma fusion energy conversion enclosed channel and appurtenances.

FIGS. 23 and 24 illustrate a derivation of an internal energy source by fusion means 6*b* in a complex multirotary valve 1. Following the path of the intake of a fusionable thermodynamically reactive fluid: (1) it is volumetrically displaced by the meshing inlet rotors 4 and a series of meshing intermediate rotors 10 of constant volume displacements of sequentially larger volumetric displacements to lower the fluid density and is heated by heat exchange means 6*a* in each segment of the interposed enclosed channel 5; (2) the low density hot fluid then enters a helical enclosed channel 5 wrapped in cooled or supercooled current carrying conductors, "magnetic bottling" means 16, which enclose a kinetic and heat energy absorbing means 17 such as circulating molten lithium for a deuterium process; (3) upon entrance into the "magnetic bottling" means 16 the thermodynamically reactive fluid is changed to a plasma 22 by ionization means 18 and heated further by resistive heating of an alternating current induced about the path of flow in the plasma 22 by a multiplicity of synchronized magnetic core transformers 19; (4) an ion neutralizing means 21 at the exit of the "magnetically bottled" plasma 22; (5) a capacitive discharge means 20 connected between the ionization means 18 and the ion neutralizing means 21 and to the primaries of the magnetic core transformers 19 for intermittent discharge of a direct and induced substantial current along and about the path of flow of the plasma 22 for magnetically "pinching" the self-contracting plasma flow; and (6) another multiplicity of meshing intermediate rotors 10 of constant volume displacements of sequentially larger volumetric displacements than the initial multiplicity of intermediate rotors 10 for expansion of the partially fusioned and energized thermodynamically reactive fluid into fedback mechanical energy. The multirotary valve is of course, driven by power driving means 11*b* until the fedback mechanical energy exceeds the input mechanical energy.

The "magnetically bottled" enclosed channel 5 is illustrated as a square cross-section in a helical path for economy and compactness, however, the cross-section need not be so limited and the path could even be straight or irregular so long as the "magnetic bottling" effectively contains the plasma 22. The cross-section need not be constant along the path but could diminish or increase dependent upon the functions desired such as slowing the nuclear particles by an enlargement of said enclosed channel 5 for effective ion neutralizing. The enclosed channel 5 would be cooled in a sustained reactor.

The expansion of the partially fusioned thermodynamically reactive fluid can be reversed at the end of the expansion and compressed and cooled even to liquification by another multiplicity of meshing intermediate rotors 10 of constant volume displacements of sequentially smaller volumetric displacement so that said fluid can be readily processed.

In the event the expansion of the partially fusioned thermodynamically reactive fluid exceeds the mechanical energy input required, a power utilizing means 11*a* can be connected to the rotary linkage 9 for external power consumption. Also, in the same event, a magnetohydrodynamic means 23 can be installed for direct energy conversion to electrical energy output.

OPERATION

It is essential to the understanding of this Invention that a pair of meshing rotors not be identified with a compressor or vacuum pump for it is only the interaction of two pairs of meshing rotors of unequal constant volume displacements that produces compression or a vacuum when the rotors are turned.

The adiabatic operation of the multirotary valve 1 illustrated by FIGS. 1 through 7, under pressure at the inlet passage 3, can best be understood by considering that one smaller constant volume displacement of the meshing inlet rotors 4 must expand in the enclosed channel 5 to fill one larger constant volume displacement of the meshing outlet rotors 7, thus the pressure is reduced in the enclosed channel 5 and outlet passage 8. For a compressible thermodynamically reactive fluid such as air, this decreases the temperature also. For a liquid such as water this will create a partial vacuum in the enclosed channel since more volume is outgoing than is incoming thus causing the liquid to partially vaporize.

The adiabatic operation of the multirotary valve 1 illustrated by FIGS. 8 through 10 is that of a simple check valve. Since the incoming volume is greater than the outgoing volume, the pressure will increase in the enclosed channel 5 until it counteracts the inlet torque and the flow ceases. For an incompressible liquid, this will occur as the enclosed channel 5 is filled. For a compressible fluid such as air, the pressure increase will not be so immediate.

Figure 11:
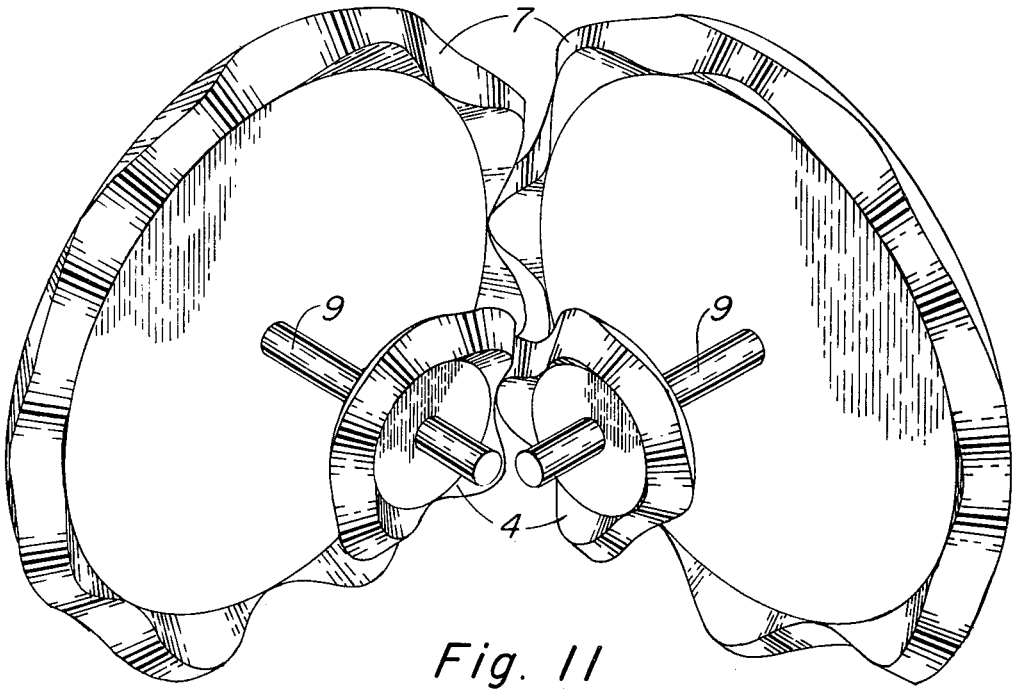
FIG. 11 is a pictorial view of the meshing rotors of the variable angle axes version of the multirotary valve with inlet rotors having smaller torque and volumetric displacement than the outlet rotors.
Figure 12:
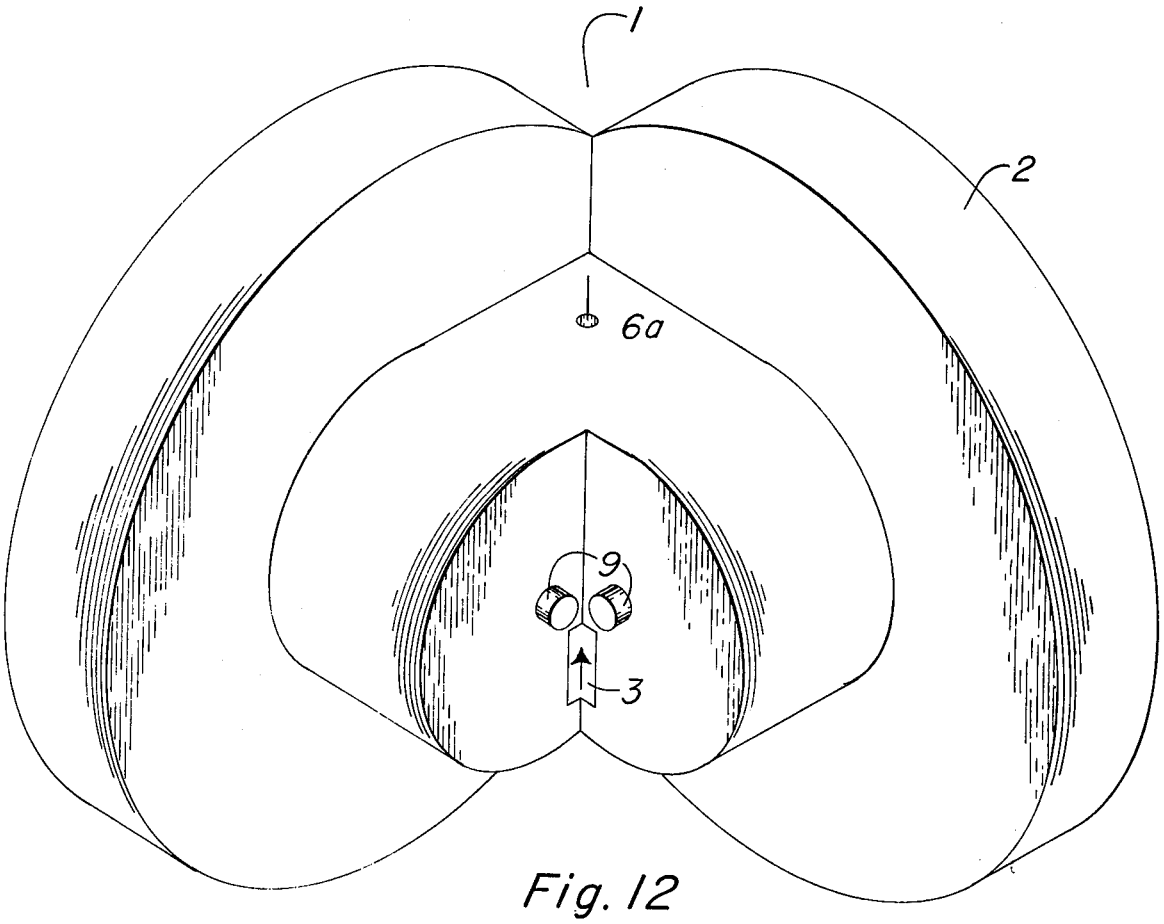
FIG. 12 is an inlet pictorial view of a variable angle axes version of the multirotary valve with inlet rotors having smaller torque and volumetric displacement than the outlet rotors.
Figure 13:
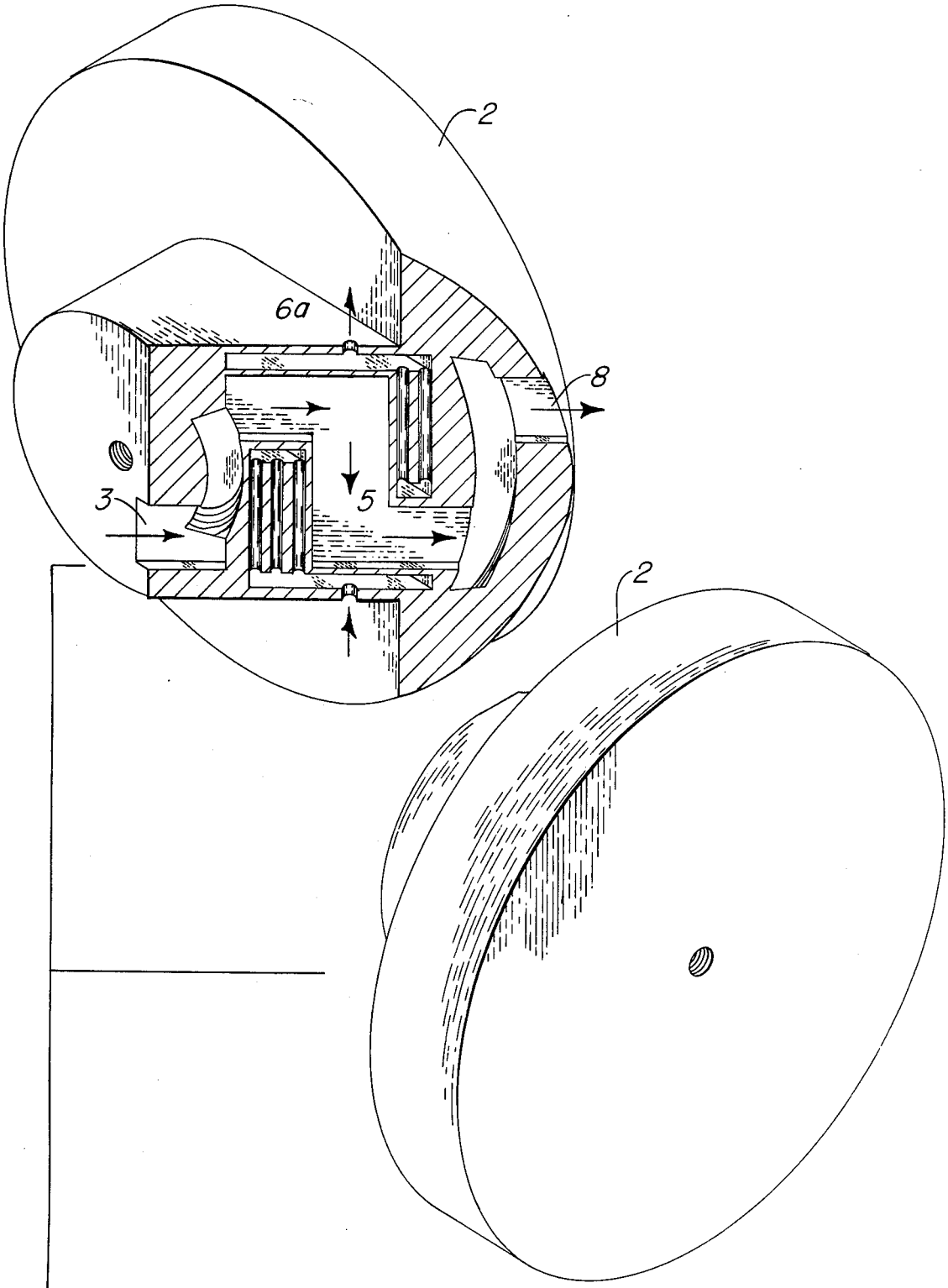
FIG. 13 is an exploded sectional view of the valve casing of a variable angle axes version of the multirotary valve with inlet rotors having smaller torque and volumetric displacement than the outlet rotors.
Figure 14:
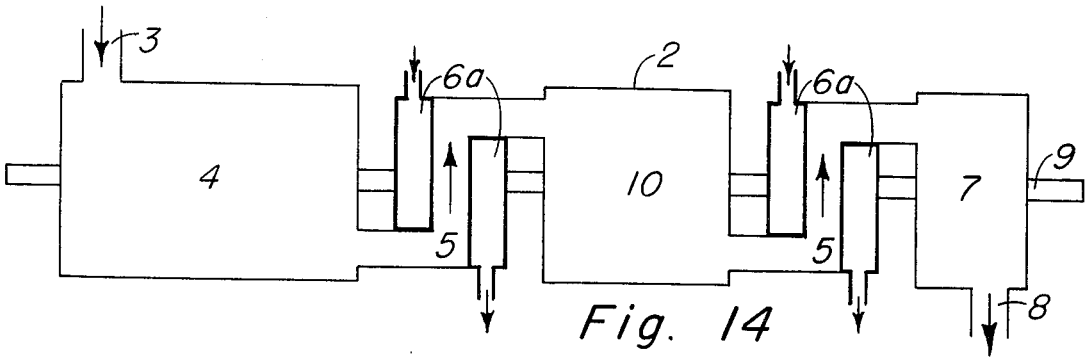
FIG. 14 is a schematic illustrating an intermediate pair of meshing rotors with volumetric displacements diminishing from inlet rotors to outlet rotors.
Figure 15:
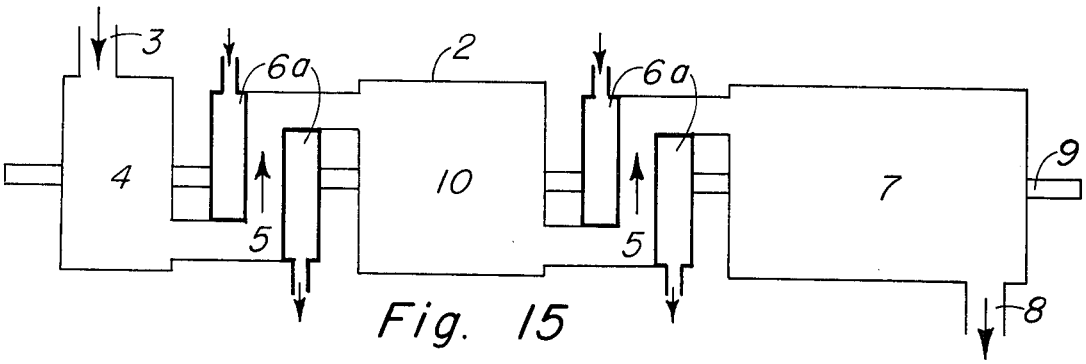
FIG. 15 is a schematic illustrating an intermediate pair of meshing rotors with volumetric displacements increasing from inlet rotors to outlet rotors.
Figure 16:
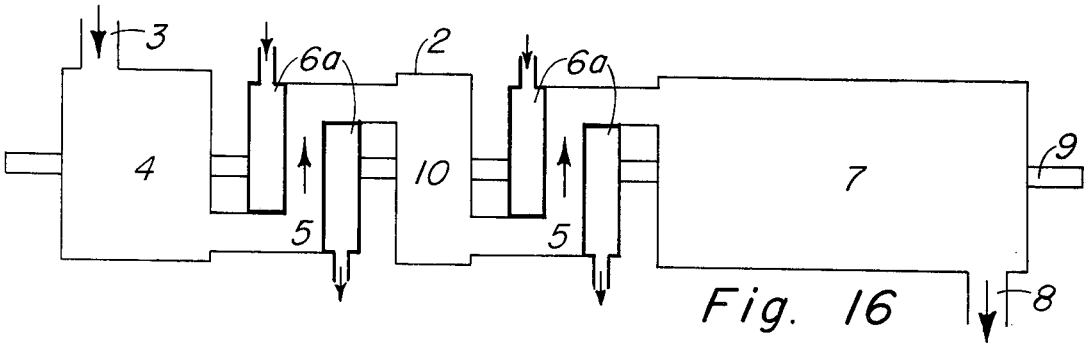
FIG. 16 is a schematic illustrating an intermediate pair of meshing rotors with volumetric displacement less than both inlet and outlet rotors.
Figure 17:
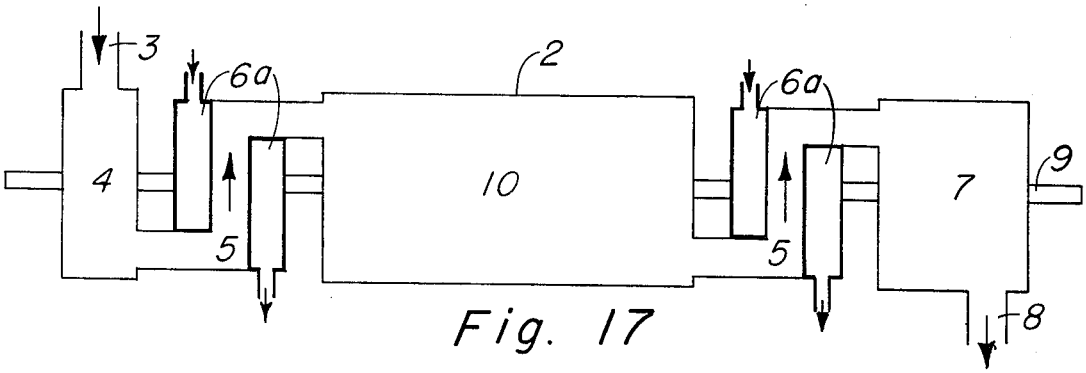
FIG. 17 is a schematic illustrating an intermediate pair of meshing rotors with volumetric displacement greater than both inlet and outlet rotors.

The multirotary valve 1 illustrated in FIGS. 11 through 13 is another method of increasing the torque and volumetric displacements of one pair of meshing rotors as well as providing rotary linkages for rotary drive purposes at various angles.

The multirotary valve 1 illustrated in FIGS. 14 through 17 indicates the various arrangements using an intermediate pair of meshing rotors 10 of constant volume displacements. Said valve can readily be utilized with a thermodynamically reactive fluid such as air for pressure, density and temperature changes as well as heat exchange means to convey heat to or from said fluid with power input or power output.

The rollers 12, illustrated in FIG. 18, assist in the sealing and lubrication of the moving parts of the multirotary valve 1 as well as retaining the pure rotary nature of said moving parts.

The "heat" engine multirotary valve 1, illustrated in FIG. 19, utilizes heat input to expand the thermodynamically reactive fluid such as air in the enclosed channel 5 and produce useful work in the form of mechanical torque.

The "cool" engine multirotary valve 1, illustrated in FIG. 20, utilizes removal of heat to contract the thermodynamically reactive fluid such as air, in the enclosed channel 5 and produce useful work in the form of mechanical torque.

The "heat" pump multirotary valve 1, illustrated by FIG. 21, compresses a thermodynamically reactive fluid such as air, thus increasing its temperature and causing heat to flow to the heat exchange means *6a* from said fluid, thus exhausting a cooler fluid and providing heat via the heat exchange means *6a*.

The "cool" pump multirotary valve 1, illustrated by FIG. 22, expands a thermodynamically reactive fluid such as air, thus decreasing its temperature and causing heat to flow to said fluid from the heat exchange means *6a*, thus exhausting a hot fluid and providing a cool means via the heat exchange means *6a*.

All four of the latter multirotary valves 1 could have a multiplicity of pairs of meshing intermediate rotors 10 interposing the enclosed channel 5 and also multiple heat exchange means *6a* for each segmented enclosed channel 5.

Nuclear fusion at present is being done by "non-flow" systems including "magnetic bottling and pinching" and with "magnetic mirrors" with ionization means and direct or induced resistive heating. Such non-flow systems accumulate impurities due to ionization or vaporization of the structural materials by straying plasma, and have to be shut down and flushed. The flowing fusion process described herein not only is self-flushing but is also capable of producing a self-contracting effect due to the unidirectional flow of the plasma which is analogous to currents flowing in the same direction in parallel conductors that attract each other except that the ions, not being confined in conductors, are free to accelerate directly toward each other. The two dimensional flowing containment of a plasma allows more freedom of manipulation and less concern for leakage and impurities than do the present three dimensional containment methods. Even the magnetic "pinching" will decrease the cross-sectional flow area thereby accelerating the velocity of flow and increasing the self-contracting effect.

The rotary linkages 9, partially illustrated herewith, are representative of a whole family of versions similar in operation. Where there are pairs of such rotary linkages 9 in a single multirotary valve 1, synchronous meshing and rotation of the meshing rotors could be insured against slip by gear means rotatably connecting said moving parts, but such gear means is not considered as fundamental.

ADVANTAGES

A material advantage of the Invention described in the foregoing specification is that it provides a multirotary energy conversion valve having purely rotating parts.

Another advantage of the Invention is that it provides a multirotary energy conversion valve of expansive functional versatility with minimal or even no structural alteration.

A further advantage of the Invention is that it allows a structural versatility heretofoe unavailable.

A still further advantage of the Invention is that it provides a multirotary energy conversion valve of minimal moving parts for ease of manufacture, maintenance and repair.

A still further advantage of the Invention is that is provides a multirotary energy conversion valve operative over a wide range of rotary speeds and quantitative flow.

A still further advantage of the Invention is that it provides a multirotary energy conversion valve of extensive applicability.

Although this Specification describes a multirotary energy conversion valve of multiple applicability, it should be understood that structural or material rearrangement of adequate or equivalent parts, substitution of equivalent functional elements and other modifications in structure can be made and other applications devised without departing from the spirit and scope of my Invention. I therefore desire that the description and drawings herein be regarded as only illustrative of my Invention and that the Invention be regarded as limited only as set forth in the following claims or as required by the state of the art.

Having thus described my invention I claim:

1. A multirotary energy conversion valve for fluids comprising:

a. a valve casing;

b. a pair of continuously meshing inlet rotors of constant volume displacements in the meshing irregular peripheries of said rotors rotatably mounted in said valve casing;

c. a pair of continuously meshing outlet rotors of constant volume displacements in the meshing irregular peripheries of said rotors rotatably mounted in said valve casing; said outlet rotors having torque characteristics and volumetric displacement rates quantitively unequal to the torque characteristics and volumetric displacement rates of said inlet rotors;

d. an inlet passage in said valve casing leading to the reappearing volumetric displacement side of said meshing inlet rotors;

e. an outlet passage in said valve casing leading from the vanishing volumetric displacement side of said meshing outlet rotors;

f. an enclosed channel in said valve casing leading from the vanishing volumetric displacement side of said meshing inlet rotors to the reappearing volumetric displacement side of said meshing outlet rotors;

g. at least one rotary linkage connecting one inlet rotor and one outlet rotor for synchronous rotation about one axis with said rotary linkage having access external to said valve casing for rotary drive purposes;

h. at least one pair of meshing intermediate rotors of constant volumetric displacements interposed in said enclosed channel with at least one intermediate rotor connected by said rotary linkage to one inlet rotor and one outlet rotor for synchronous rotation about one axis;

i. a multiplicity of meshing intermediate rotors of constant volume displacements of sequentially larger volumetric displacement rates with heat exchange means in each divided segment of said enclosed channel whereby a fusionable thermodynamic fluid is diminished in density and increased in temperature under flowing conditions;

j. at the end of said multiplicity of meshing intermediate rotors with heat exchange means, a fusion means for said enclosed channel comprising:

1. an enclosed channel with cooled current carrying conductors about the enclosed channel, said current carrying conductors producing a magnetic field in said enclosed channel with the magnetic lines of force being parallel to the centerline of said enclosed channel whereby the ions flowing through said channel and crossing said magnetic lines would be accelerated back toward said centerline of said enclosed channel for "magnetic bottling" means, said enclosed channel being encased in a kinetic and heat energy absorbing means for energy conversion of the fusion products;

2. an ionization and ion neutralizing means at the ends of said "magnetically bottled" enclosed channel whereby the flowing thermodynamic fusionable fluid is converted to a plasma at the entrance and neutralized at the exit of said enclosed channel;

3. a multiplicity of magnetic core transformers surrounding said enclosed channel and being electrically synchronized in such a manner as to produce secondary alternating current about the path of flow for resistive heating of said plasma; and 4. capacitive discharge means connected to the ionization means and ion neutralizing means and the primary of the magnetic core transformers for intermittent discharge of a substantial current along and about the path of plasma flow whereby the unidirectional self contracting plasma flow will be magnetically "pinched" for further contraction;

k. another multiplicity of meshing intermediate rotors of constant volume displacements of sequentially larger volumetric displacement rates whereby the partially fusioned thermodynamic fluid is volumetrically expanded; and l. a power driving means for said multirotary valve whereby said power driving means is utilized to the limit of self sustaining operation of said multirotary valve by the expansion of the partially fusioned thermodynamic fluid.

2. An energy conversion valve as described in claim 1 with a helical enclosed channel with "magnetic bottling" means intermittently amplified by capacitive discharge means diminishing in cross-sectional flow area in the direction of flow whereby the "magnetic bottling" means contracts the flowing plasma and increases the speed of the nuclear particles.

3. An energy conversion valve as described in claim 1, said cooled current carrying conductors being supercooled.

4. An energy conversion valve as described in claim 1 with an enlarged magnetic bottling means for slowing the flow and containing any residual ionized particles until neutralized by ion neutralizing means in said enlarged "magnetic bottling" means.

5. An energy conversion valve as described in claim 1 having a multiplicity of meshing intermediate rotors of constant volume displacements of sequentially smaller volumetric displacement with heat exchange means in each divided segment of said enclosed channel just prior to the meshing outlet rotors whereby the partially fusioned thermodynamic fluid is compressed and cooled in preparation for separation of the fluid constituents.

6. An energy conversion valve as described in claim 1, including a power utilizing means from said multirotary valve connectable to said rotary linkage when the expansion of the partially fusioned thermodynamic fluid is more than sufficient to drive said multirotary valve.

7. An energy conversion valve as described in claim 5, including a power utilizing means from said multirotary valve connectable to said rotary linkage when the expansion of the partially fusioned thermodynamic fluid is more than sufficient to drive said multirotary valve.

8. An energy conversion valve as described in claim 1 having a magnetohydrodynamic means prior to neutralizing the plasma for energy conversion directly to electrical power output from the partially fusioned flowing plasma.

* * * * *